US008795437B2

(12) United States Patent
Walter et al.

(10) Patent No.: US 8,795,437 B2
(45) Date of Patent: Aug. 5, 2014

(54) DISHWASHER WITH BASKET DETECTING DEVICE

(75) Inventors: Per Walter, Flyinge (SE); Hans Bramevik, Vellinge (SE)

(73) Assignee: GS Development AB, Malmo (SE)

( * ) Notice: Subject to any disclaimer, the term of this patent is extended or adjusted under 35 U.S.C. 154(b) by 560 days.

(21) Appl. No.: 12/524,285

(22) PCT Filed: Jan. 23, 2008

(86) PCT No.: PCT/EP2008/050766

§ 371 (c)(1),
(2), (4) Date: Jun. 9, 2010

(87) PCT Pub. No.: WO2008/090180

PCT Pub. Date: Jul. 31, 2008

(65) Prior Publication Data

US 2010/0275954 A1 Nov. 4, 2010

(30) Foreign Application Priority Data

Jan. 26, 2007 (SE) ..... 0700194

(51) Int. Cl.
*B08B 3/02* (2006.01)
*B08B 3/04* (2006.01)

(52) U.S. Cl.
USPC ..... 134/18; 134/7; 134/25.2; 134/56 D; 134/58 D; 134/140; 134/147; 134/148

(58) Field of Classification Search
USPC ..... 134/7, 8, 18, 25.2, 56 D, 58 D, 140, 148, 134/184, 199, 200
See application file for complete search history.

(56) References Cited

U.S. PATENT DOCUMENTS 2,501,887 A * 3/1950 Cress ..... 134/148
3,718,149 A * 2/1973 Mazza ..... 134/57 D (Continued)

FOREIGN PATENT DOCUMENTS

DE 10 2008 033 741 1/2010
EP 0 820 718 1/1998

(Continued)

OTHER PUBLICATIONS

Press release confirming the introduction of Granuldisk Combi accessed on May 8, 2013 at http://www.granuldisk.com/whats-up/news/news/browse/7/article/world-premiere-1.h. 1 page.

(Continued)

*Primary Examiner* — Michael Barr
*Assistant Examiner* — Natasha Campbell
(74) *Attorney, Agent, or Firm* — Merchant & Gould P.C.

(57) ABSTRACT

A dishwasher (100) for pot washing, comprising a detector (160) for automatically detecting what type of washing basket (140) has been placed in the dishwasher (100). This enables automatic selection of water pressure and granule control, such that more sensitive crockery and plates are not damaged. The detector can be an inductive sensor (160) that detects an indicating member (141) of the washing basket. The washing basket can comprise one or several indicating members, for enabling a more reliable detection. A method of operating such a dishwasher (100) comprises the steps of automatically detecting what type of washing basket (140) is placed in the dishwasher, and then controlling the water pressure and granule addition according to what washing basket was detected. A system comprises an above dishwasher and an above washing basket.

17 Claims, 5 Drawing Sheets

(56) References Cited

U.S. PATENT DOCUMENTS

| | | | | | |
|---|---|---|---|---|---|
| 3,858,595 | A | | 1/1975 | Schultz et al. | |
| 3,979,289 | A | * | 9/1976 | Bykowski et al. | 210/784 |
| 4,358,960 | A | * | 11/1982 | Porter | 73/705 |
| 4,832,862 | A | * | 5/1989 | Joubert et al. | 510/220 |
| 5,131,419 | A | | 7/1992 | Roberts | |
| 5,498,958 | A | * | 3/1996 | Tu et al. | 324/207.16 |
| 5,601,480 | A | * | 2/1997 | Nilen | 451/88 |
| 5,629,275 | A | * | 5/1997 | Bauer et al. | 510/108 |
| 5,771,909 | A | | 6/1998 | Hein et al. | |
| 2002/0020435 | A1 | | 2/2002 | Varpio | |
| 2003/0199231 | A1 | | 10/2003 | Rogmark | |

FOREIGN PATENT DOCUMENTS

| | | |
|---|---|---|
| FR | 2 735 348 | 12/1996 |
| SE | 9200856 | 3/1992 |
| SE | 524021 | 6/2004 |
| SE | 531 890 | 9/2009 |
| WO | WO 80/02105 | 10/1980 |
| WO | WO 92/15237 | 9/1992 |

OTHER PUBLICATIONS

Press release confirming the indroduction of Granuldisk Combi accessed May 8, 2013 at http://www.granuldisk.com/whats-up/news/news/browse/7/article/success-at-host-200. 1 page.

Sales brochure for Granuldisk Combi accessed on May 8, 2013 at http://www.granuldisk.com/uploads/media/4P__COMBI__EN__web.pdf. 4 pages.

Notary Publics execution protocol dated May 24, 2013 certifying that the press releases were retrieved on the date from the web addresses, 8 pages.

* cited by examiner

DISHWASHER WITH BASKET DETECTING DEVICE

This application is a National Stage Application of PCT/EP2008/050766, filed 23 Jan. 2008, which claims benefit of Serial No. 0700194-4, filed 26 Jan. 2007 in Sweden and which applications are incorporated herein by reference. To the extent appropriate, a claim of priority is made to each of the above disclosed applications.

FIELD OF THE INVENTION

The present invention relates to a dishwasher using granules for washing pots and pans and a washing basket for holding dirty dishes. It further relates to a method of operating the dishwasher and a system of a dishwasher and a washing basket.

BACKGROUND OF THE INVENTION

Dishwashers for pot washing traditionally operate with high water pressure and sometimes with granules added to the water. This efficiently cleans pots and pans, but will lead to breakage and scratching of traditional wares, such as crockery, cutlery and glasses. For this reason, separate dishwashers are provided in large-scale kitchens for handling traditional, more sensitive items. This is costly and space consuming.

SUMMARY OF THE INVENTION

It is an object of the present invention to mitigate, alleviate or eliminate one or more of the above-identified deficiencies and disadvantages singly or in any combination. This is in one aspect solved by providing a dishwasher for pot washing which comprises a detector for automatically detecting what type of washing basket has been placed in the dishwasher. The water pressure and granule valve is controlled, so that the more sensitive crockery and glasses are not damaged.

In another aspect of the invention, a washing basket is provided which comprises indicating members. These members are used in conjunction with the detector in the dishwasher of the first aspect.

In yet another aspect, a method is provided for operating a dishwasher, said method comprising the steps of automatically detecting what type of washing basket has been placed in the dishwasher.

In another aspect, a system is provided which comprises a dishwasher of the first aspect and a washing basket of the second aspect.

Further embodiments are given by the dependent claims of the above given aspects.

BRIEF DESCRIPTION OF THE DRAWINGS

The accumulator of the present invention will be more readily understood by reading the following detailed description in combination with the appended non-limiting drawings, where.

DETAILED DESCRIPTION OF PREFERRED EMBODIMENTS

Below, several embodiments of the invention will be described with references to the drawings. These embodiments are described for illustrative purposes only, in order to enable a skilled person to carry out the invention and to disclose the best mode. However, such embodiments do not limit the invention. Moreover, other combinations of the different features are possible within the scope of the invention.

Figure 1:
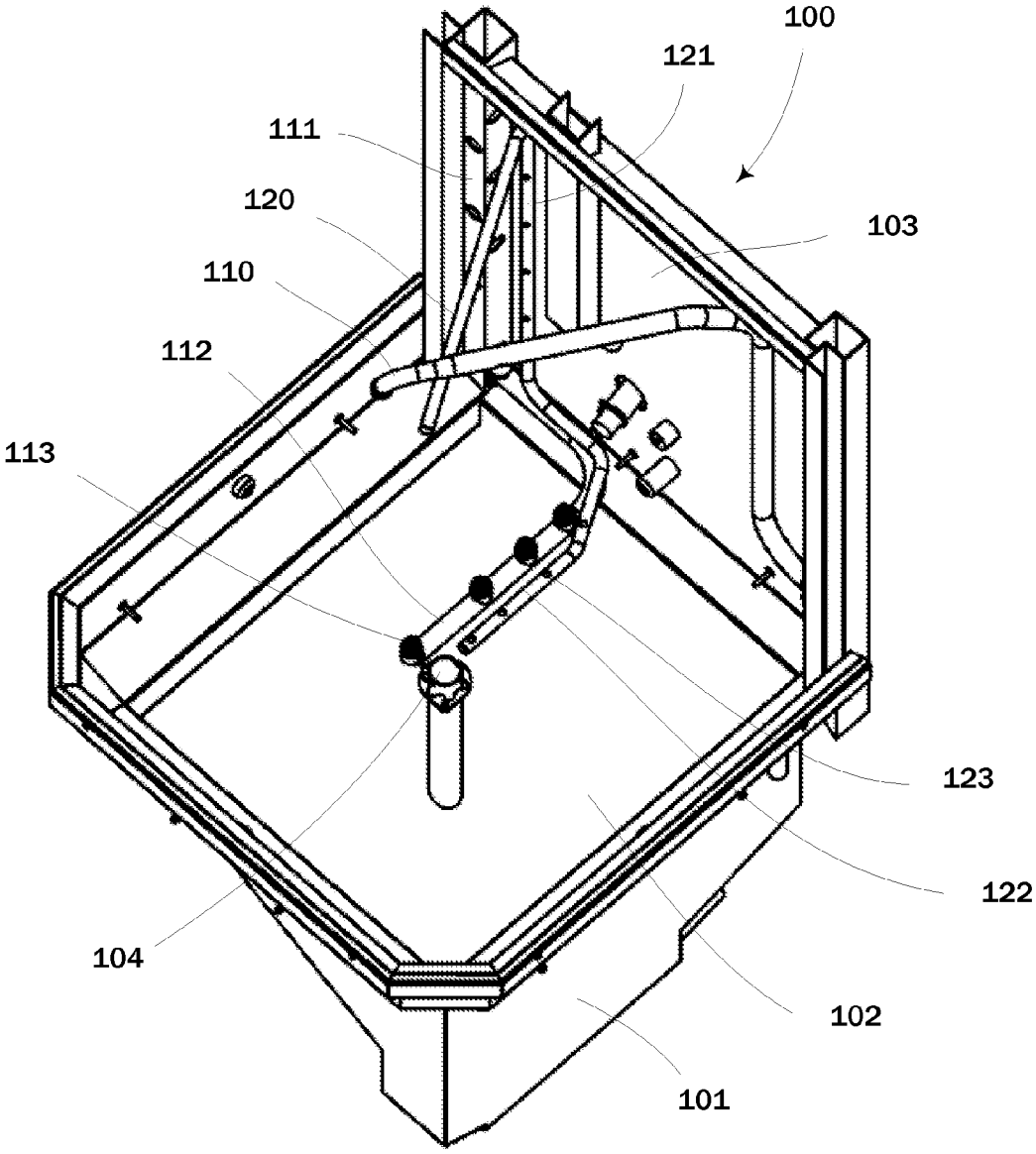
FIG. 1 is a perspective view of a dishwasher according to the invention.

A dishwasher 100 is shown in a perspective view in FIG. 1. The dishwasher comprises a stand 101, a bottom wall 102 and a back wall 103. The top and sides of the dishwasher is enclosed by, e.g., a vertically adjustable hood (not shown). The dishwasher in FIG. 1 also comprises a hub 104, which is arranged in a central part of the bottom wall 102. The hub 104 comprises a rotatable portion, which is coupled to a driving unit, such as an electric motor (not shown). A different form of driving unit is possible, which may be placed in an offset position of the dishwasher.

The dishwasher 100 can further comprise a top washing tube 110, side washing tube(s) 111 and a bottom washing tube 112. Spraying nozzles 113 are arranged on the washing tubes.

The dishwasher may also comprise a top rinsing tube 120, a side rinsing tube 121 and a bottom rinsing tube 122, on which rinsing nozzles 123 are arranged. The exact location or number of washing tubes or rinsing tubes in the shown embodiments is merely exemplary.

Figure 2:
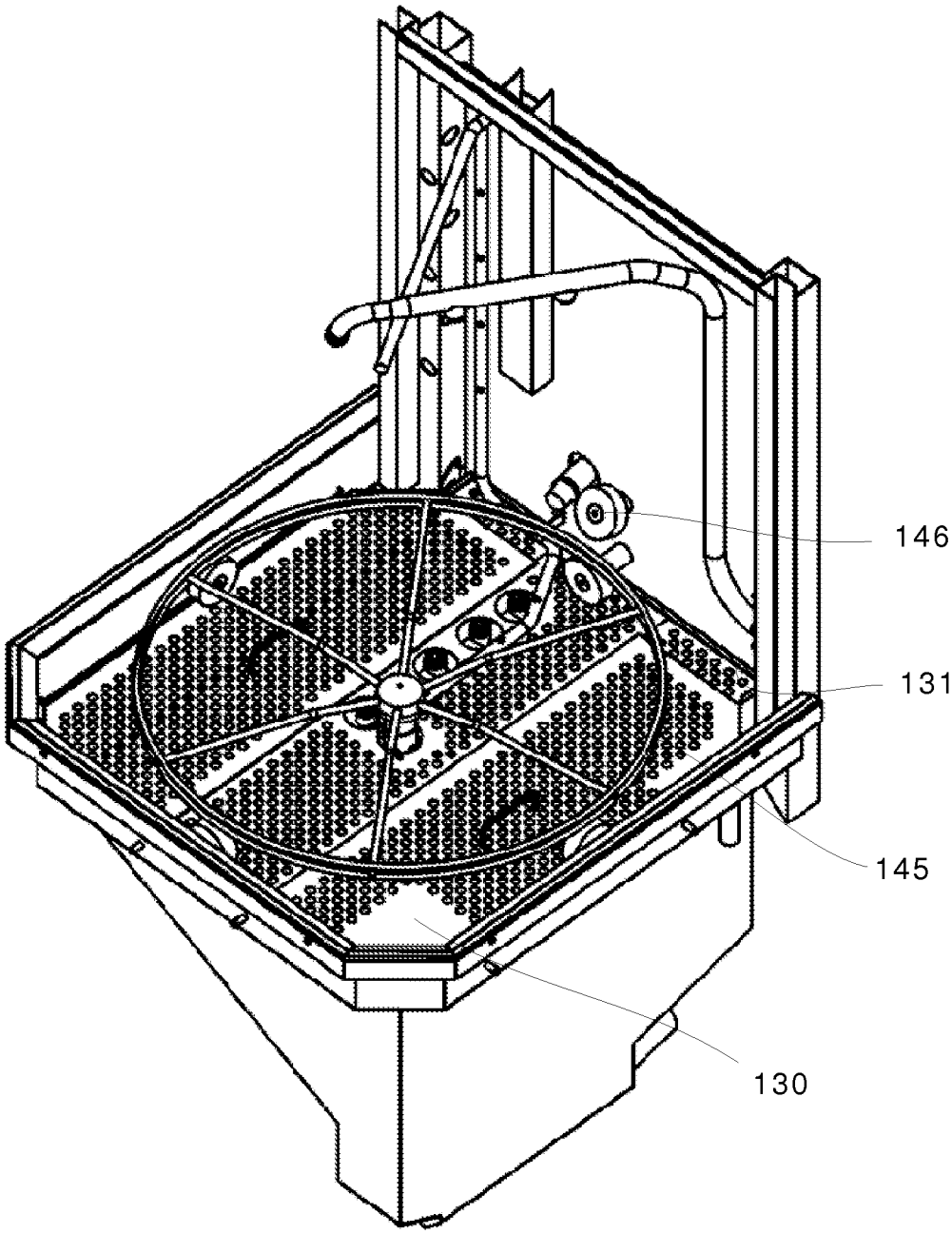
FIG. 2 is a perspective view of the dishwasher in FIG. 1, where a basket carrier has been placed on a central hub.
Figure 5:
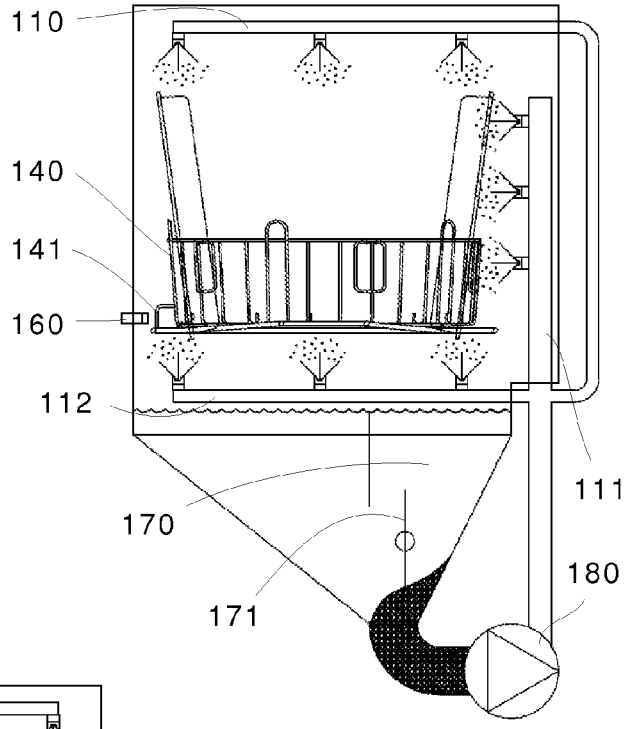
FIG. 5 is a schematical side view of the dishwasher according to the invention, having a pot-washing basket.
Figure 6:
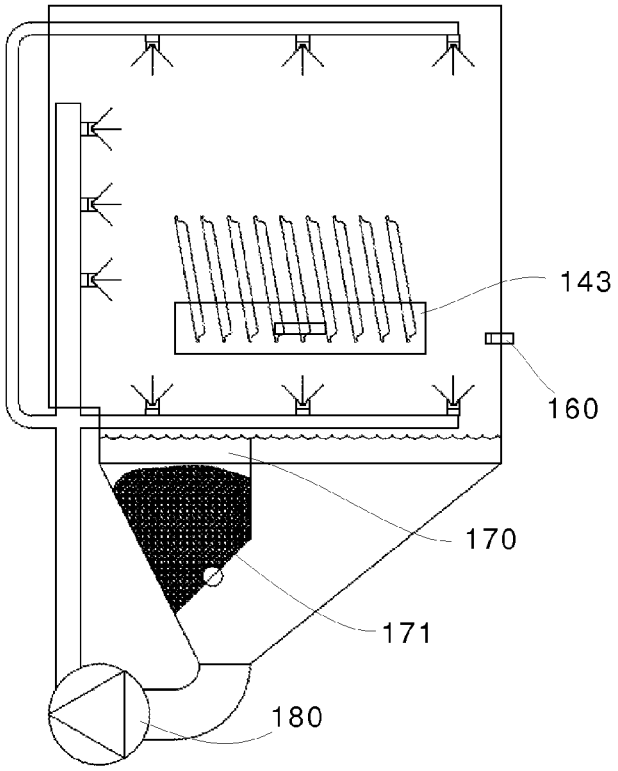
FIG. 6 is a schematical side view of the dishwasher according to the invention, having a standard washing basket for crockery and glasses.

With reference to FIG. 2, the dishwasher can moreover comprise a bottom screen 130, which is mounted at a distance above the bottom wall 102. A pot-washing basket 140 is seen arranged in the dishwasher, and a standardized pot 150 can be seen placed in the basket 140, see FIG. 3. The lower part of the dishwasher may also comprise a granule compartment 170, see FIGS. 5 and 6, where the granules are collected. This compartment 170 can be fitted with a granule valve 171, for controlling the addition of granules to the washing water.

The bottom screen 130 is arranged at a distance above the bottom wall 102, and can in one embodiment be placed above the highest water level in the dishwasher. The screen 130 will then obscure the view of the dirty dishwater, which improves the appearance of the interior of the dishwasher. The screen 130 can moreover be fitted with an upwardly extending peripheral edge 131, indicated in FIG. 1, which captures e.g. cutlery and prevent them from falling into the dishwater or the granule compartment 170. This edge 131 substantially extends along the entire outer periphery of the bottom screen 130.

Figure 3A:
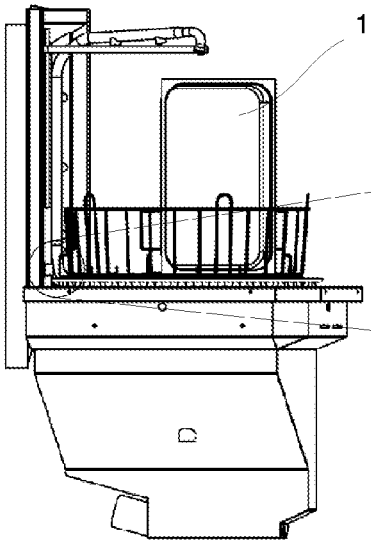
FIG. 3*a* is a side view of the dishwasher in FIG. 2, where a pot-washing basket with a canteen has been placed on the basket carrier.
Figure 3B:
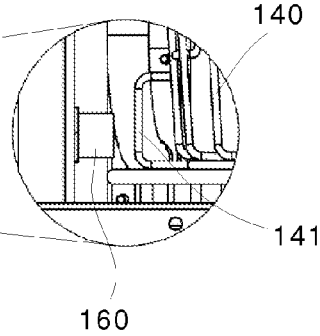
FIG. 3*b* is an enlarged view of a detector and an indicating member of FIG. 3*a*.

With reference to FIG. 3*a*, the dishwasher 100 is seen with the pot-washing basket 140 and a therein-placed canteen. FIG. 3*b* shows an enlarged view of FIG. 3*a*, at the back wall 103, where an inductive detector 160 is mounted to said back wall 103. An indicating member in the form of an arm 141 is shown extending outwards from the pot-washing basket 140.

The basket 140 can have one or several indicating arms 141. In one embodiment, at least two indicating arms 141 are provided on the basket.

Figure 4A:
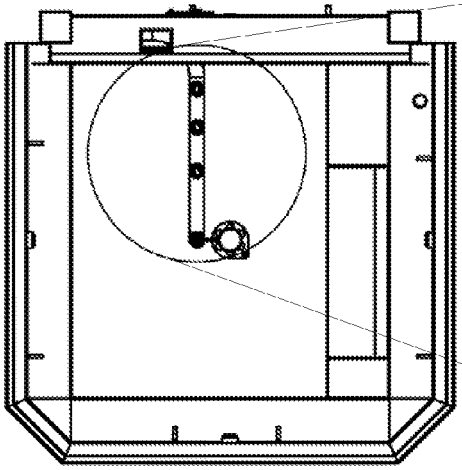
FIG. 4*a* is a top view of the dishwasher in FIG. 1
Figure 4B:
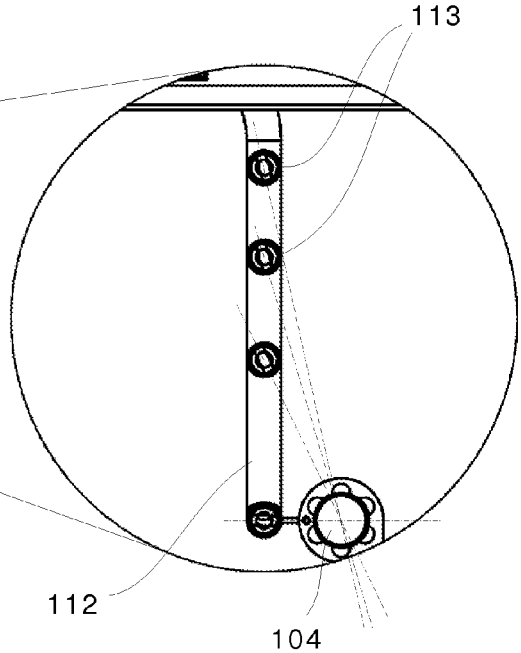
FIG. 4*b* is an enlarged view of the bottom spraying tube and the central hub.

In FIGS. 4*a* and 4*b*, the dishwasher is seen from above. The position of the bottom washing tube 112 is clearly visible. The lower spraying tube 112 makes it possible to e.g. wash glasses, bowls and canteens that are placed upside down in a standard washing basket 143 or in a pot-washing basket 140.

The position of the spraying nozzles 113 can be seen clearly in FIG. 4*b*. The shown nozzles are provided with an elongated opening, for spraying a substantially planar jet. The nozzles are specially designed for spraying water and/or granules. The elongated openings of the spraying nozzles 113 are in the shown embodiment oriented towards the centrally located hub 104, and this is indicated with phantom lines. This means that a planar fluid jet leaving the elongated opening will be perpendicular to the rotation of the washing basket 140, 143, at each corresponding nozzle position. The nozzles are in one embodiment placed closer together at the outer periphery of the dishwasher, in order to compensate for the fact that the peripheral speed increases with the radius from the hub 104. This improves the coverage of the water jets from the spraying nozzles 113. Other nozzle shapes, such as circular, curved or similar, are possible for spraying water jets of different shapes.

The dishwasher comprises a water pump 180, which can operate at different speeds, leading to different water pressures and flows. A low speed is used for washing up crockery, cutlery and glasses and a higher speed is used for pot washing. In one embodiment, the pump 180 comprises a squirrel-cage electric motor comprising two windings, where one winding gives a low speed and the other winding gives a higher speed. The speed of the water pump and the resulting water pressure should be adjusted to the specific machine and what type of glassware or pots that are going to be cleaned. In one embodiment, the high water pressure is about 0.8-1.0 atm gauge (1.8-2.0 atm absolute) and the low water pressure is about 0.2-0.4 atm gauge (1.2-1.4 atm absolute). The water flow is about 800-1100 liters per minute at high pressure, and it is about 300-450 liters per minute at low pressure. This depends on the specific application, and both higher and lower flows are possible.

The water pump 180 can also be driven by a standard electric motor, which is controlled by a speed regulator of a known type, such as a frequency changer or a variable-frequency drive. This is a more costly solution, but gives more flexibility and several different speeds and water flows can be chosen.

Alternative Embodiments

The dishwasher 100 comprises a means for detecting if a pot-washing basket 140 is placed in the dishwasher, in order to automatically separate between washing up of pots and more sensitive crockery and glasses. In one embodiment, this is detected by a wheel 146, which rides on a peripheral edge on the pot-washing basket 140. Such a wheel is often fitted in dishwashers of a known kind, for guiding the pot-washing basket 140 during its rotation in the dishwasher. If the wheel 146 rotates in a predetermined fashion, it can be determined if a pot-washing basket 140 has been inserted into the machine.

It is also possible to arrange an optical detector on a side, top or bottom wall of the dishwasher, for detecting a reflective surface (as an alternative indicating member) of the pot-washing basket 140. Such a reflective surface can have been placed on the pot-washing basket 140, in order to clearly distinguish between reflections from cutlery or glasses, on one hand, and the indicating reflective surfaces of the pot-washing basket, on the other hand. In one embodiment, two or more reflective surfaces are arranged so that a detection frequency can be obtained, which differs from the rotational speed of the pot-washing basket. This increases the accuracy of the detection, and the more sensitive crockery and glasses can more reliably be protected from damage. In one embodiment, the optical detector comprises, or works in conjunction with, a radiation source that emits electromagnetic radiation, such as visible light or infrared light. The vertical metallic bars on the pot-washing basket can in another embodiment be used as the indicating members 141.

The indicating members 141 of the pot-washing basket 140 do not have to be evenly spaced, but can have any predetermined spacing. The spacing will affect the signal that is detected by the detector, but this will be compared to reference data that has been gathered in advance. The rotational speed of the basket will also affect the frequency of the detected signal.

It is also possible to arrange an ultrasonic unit or a capacitive sensor in the dishwasher, for detecting an indicating member on the pot-washing basket.

Optionally, it is possible to move the detector 160, either linearly or in a circular path around the interior of the dishwasher, and keep the basket carrier stationary, for detecting the presence of a pot-washing basket 140.

In one embodiment, all washing tubes 110, 111, 112 are supplied water from the same water pump 180. The water pump 180 can operate at least two separate speeds, which leads to at least two different water pressures and flows. In another embodiment, two different water pumps are arranged in the dishwasher 100. One water pump operates when high water pressure is desired (pot washing) and the other water pump operates when a low water pressure is desired (washing of crockery and glasses). The two water pumps can supply water to different washing tubes. In one embodiment, the water pump that delivers high water pressure is connected to the side washing tube(s) 111, and the water pump that delivers low water pressure is connected to the top and bottom washing tubes 110, 112. If wanted, the two water pumps can be operated simultaneously during pot washing.

In the above description, only the pot-washing basket 140 is shown with indicating members. However, the standard washing basket can similarly be equipped with indicating members 141, which are arranged in a different fashion than on the pot-washing basket 140. This makes it possible to distinguish the standard washing basket 143 from the pot-washing basket 140. It is also possible to equip only the standard washing basket 143 with indicating members 141, while the pot-washing basket 140 lacks indicating members 141, such that the absence of detected signals will indicate that a pot-washing basket 140 has been placed in the dishwasher 100.

Operation

Figure 7:
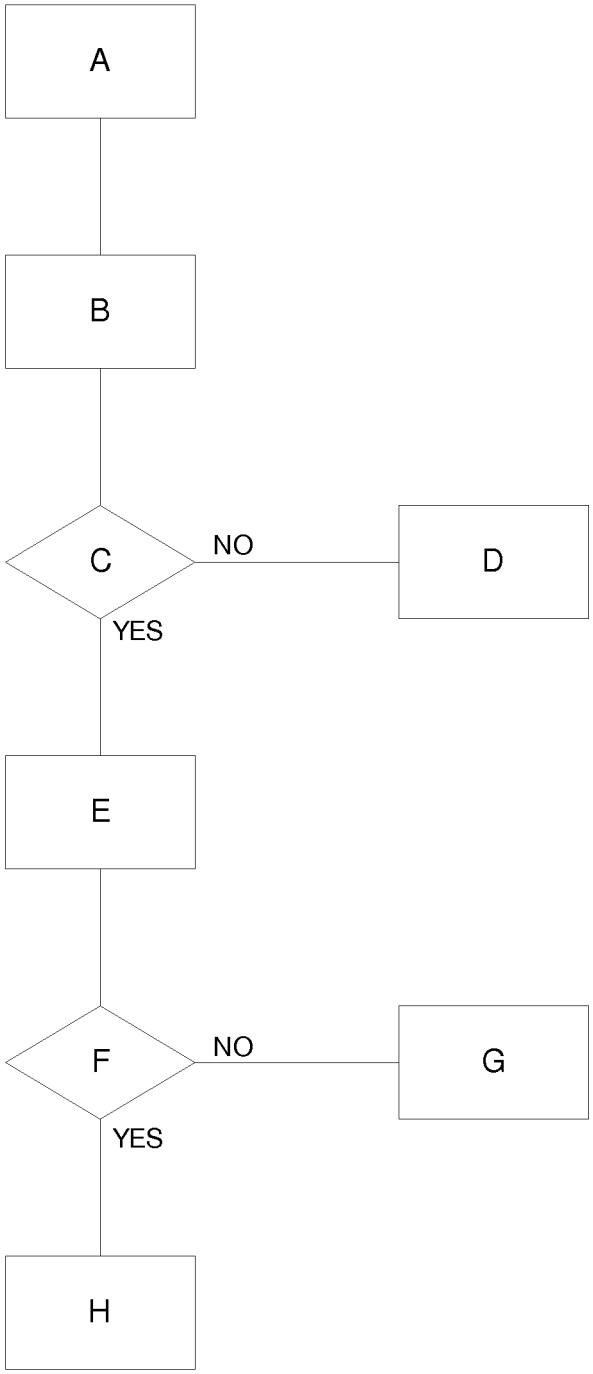
FIG. 7 is a schematical view of an algorithm for an operation method of the dishwasher according to the invention.

The operation of the dishwasher is shown schematically in FIG. 7 in the form of an algorithm. Additional steps are possible and not all the shown steps are necessary for carrying out the process of the invention.

The first step A involves initial steps, such as closing discharge valves and the hood (if either of them are open). In step B, the driving unit is started for rotating a basket 140, 143 that is placed on the basket carrier 145. The water pump 180 is started at a low speed, which leads to a low water pressure and flow. In step C, a sensor is activated for checking that the basket is actually rotating. If not, the dishwasher is stopped in step D. Otherwise the dishwasher enters a detection phase in step E. A detector 160 is activated for detecting what type of washing basket 140, 143 that has been placed in the basket carrier, by counting pulses and determining the frequency of the pulses. In the embodiment shown in FIG. 3, the pulses are generated when the indicating arms 141 pass by the detector 160, caused by the driving unit 104 rotating the basket carrier 145 and hence the basket 140, 143. If two or more pulses are detected at a certain predetermined frequency, the dishwasher establishes the type of washing basket 140, 143 that has been placed in the dishwasher. Step G is chosen for a standard washing basket and step H for a pot-washing basket. In step H, high water pressure can be used together with granules, if wanted. If the standard washing basket is detected, low water pressure should be used and the granule valve 171 should be closed. Otherwise, the high-pressure water flow might damage sensitive crockery and glasses in the standard washing basket.

The pot-washing mode in step H can include additional steps, such as addition of granules, control of temperatures, duration of washing cycle etc. The standard washing mode in step G can include similar additional steps, with the exception of the granule step.

In the claims, the term "comprises/comprising" does not exclude the presence of other elements or steps. Furthermore, although individually listed, a plurality of means, elements or method steps may be implemented. Additionally, although individual features may be included in different claims, the individual features may be combined separately in other combinations, and the inclusion of the features in different claims does not imply that another combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

Although the present invention has been described above with reference to specific embodiment, it is not intended to be limited to the specific form set forth herein. Rather, the invention is limited only by the accompanying claims and other embodiments than those described above are equally possible within the scope of the appended claims.

The invention claimed is:

1. Dishwasher for pot washing, said dishwasher having a detector for automatically detecting if a pot-washing basket or a standard washing basket has been placed in the dishwasher, being capable of providing a higher and a lower water pressure, the dishwasher further comprises means for enabling/disabling granules to be added to the dishwater, and is adapted to rotate a basket carrier, on which the pot-washing basket or the standard washing basket is placed, activate the detector, gather a signal from the detector, and analyze the detected signal for a frequency that depends on the rotational speed of the basket and an indicating member of the basket to indicate whether the basket is the pot-washing basket or the standard washing basket, enable addition of granules and provide the higher water pressure if the detector detects a pot-washing basket, and disable addition of granules and provide the low water pressure if the detector does not detect a pot-washing basket.

2. Dishwasher according to claim 1, wherein the detector is an inductive sensor for detecting the presence of a metallic indicating member on the washing basket.

3. Dishwasher according to claim 1, further comprising a rotatable drive for rotating a basket carrier.

4. Dishwasher according to claim 1, further comprising a water pump being operable for providing two different water pressures.

5. Dishwasher according to claim 4, wherein the water pump is driven by an electric motor comprising two windings.

6. Dishwasher according to claim 1, further comprising a bottom spraying tube being located in the bottom of the dishwasher, for spraying water from below onto dirty dishes in the pot-washing basket or the standard washing basket.

7. Dishwasher according to claim 6, wherein nozzles of the bottom spraying tube comprises elongated openings, which are directed towards the center of rotation of a basket carrier.

8. Dishwasher according to claim 6, wherein the bottom spraying tube comprises nozzles which are more closely spaced at the outer periphery of the dishwasher.

9. Dishwasher according to claim 1, wherein the detector is an optical detector that works in conjunction with a radiation source.

10. Washing basket for a dishwasher according to claim 1, comprising indicating members.

11. Washing basket according to claim 10, wherein at least two indicating members are arranged on the washing basket.

12. Washing basket according to claim 10, wherein the indicating members of the washing basket comprises at least one outwardly extending metal arm.

13. Washing basket according to claim 10, wherein the indicating member comprises a reflective surface.

14. Method of operating a dishwasher for pot washing, comprising rotating a basket carrier, on which a basket is placed, activating a detector, gathering a signal from the detector, and analyzing the detected signal for a frequency that depends on the rotational speed of the basket and an indicating member of the basket to indicate whether the basket is the pot washing basket or the standard washing basket of the basket, automatically detecting if the basket is a pot-washing basket or a standard washing basket, and, if a pot-washing basket is detected, operating the dishwasher at high water pressure and allowing granules to be added to the water, otherwise operating the dishwasher at low water pressure and disabling granule operation.

15. System comprising a dishwasher and a pot-washing basket having indicating members, the dishwasher:

having a detector for automatically detecting if a pot-washing basket or a standard washing basket has been placed in the dishwasher, being capable of providing a higher water pressure and a lower water pressure, the dishwasher further comprises means for enabling/disabling granules to be added to the dishwater, and is adapted to rotate the basket carrier, on which the pot-washing basket or the standard washing basket is placed, activate the detector, gather a signal from the detector, and analyze the detected signal for a frequency that depends on the rotational speed of the basket and an indicating member of the basket to indicate whether the basket is the pot-washing basket or the standard washing basket, enable addition of granules and provide the higher water pressure if the detector detects the pot-washing basket, and disable addition of granules and provide the low water pressure if the detector does not detect the pot-washing basket.

16. System according to claim 15, wherein the washing basket comprises an indication member that works in conjunction with a detector of the dishwasher, such that the type of washing basket can be determined automatically during operation of the dishwasher.

17. A dishwasher according to claim 1, wherein the granule compartment comprises a granule valve for controlling the addition of granules to the dishwater.

* * * * *